US006244547B1

(12) United States Patent
Tonizzo et al.

(10) Patent No.: US 6,244,547 B1
(45) Date of Patent: Jun. 12, 2001

(54) KEYBOARD TRAY WITH ADJUSTABLE WRIST SUPPORT

(75) Inventors: David Tonizzo, Toronto; Mihai L. Ola, Kitchener, both of (CA); Daniel C. K. West, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/495,107

(22) Filed: Feb. 1, 2000

(51) Int. Cl.[7] ..... B43L 15/00

(52) U.S. Cl. ..... 248/118.3; 248/118; 248/118.1; 248/918

(58) Field of Search ..... 248/118.3, 118, 248/346.04, 118.1, 918

(56) References Cited

U.S. PATENT DOCUMENTS

| | | | |
|---|---|---|---|
| 1,277,169 | | 8/1918 | Anderson . |
| 1,801,669 | | 4/1931 | Hintz et al. . |
| 2,950,890 | | 8/1960 | Hough, Jr. . |
| 4,545,554 | | 10/1985 | Latino et al. . |
| 4,688,862 | | 8/1987 | Fowler et al. . |
| 4,913,390 | | 4/1990 | Berke . |
| 4,973,176 | | 11/1990 | Dietrich . |
| 4,976,407 | * | 12/1990 | Schwartz et al. ..... 248/118.3 |
| 4,988,066 | | 1/1991 | Cotterill . |
| 5,037,054 | | 8/1991 | McConnell . |
| 5,058,840 | | 10/1991 | Moss et al. . |
| 5,072,905 | | 12/1991 | Hyatt . |
| 5,098,053 | | 3/1992 | Cotterill . |
| 5,108,057 | | 4/1992 | Dandy, III et al. . |
| 5,158,256 | | 10/1992 | Gross . |
| 5,183,230 | | 2/1993 | Walker et al. . |
| 5,219,136 | | 6/1993 | Hassel et al. . |
| 5,234,186 | | 8/1993 | Powell . |
| 5,242,139 | | 9/1993 | Aldrich . |
| 5,257,767 | | 11/1993 | McConnell . |
| 5,292,097 | | 3/1994 | Russell . |
| 5,294,087 | | 3/1994 | Drabczyk et al. . |
| 5,374,018 | | 12/1994 | Daneshvar . |
| 5,375,800 | | 12/1994 | Wilcox et al. . |
| 5,377,951 | | 1/1995 | Johnson et al. . |
| 5,398,896 | * | 3/1995 | Terbrack ..... 248/118.5 |
| 5,421,543 | | 6/1995 | Rossman et al. . |
| 5,443,237 | | 8/1995 | Stadtmauer . |
| 5,465,931 | * | 11/1995 | MacDonald ..... 248/118.3 |
| 5,487,525 | | 1/1996 | Drabczyk et al. . |
| 5,492,298 | | 2/1996 | Walker . |
| 5,507,458 | | 4/1996 | Campbell et al. . |
| 5,509,628 | | 4/1996 | Noble . |
| 5,513,579 | | 5/1996 | Allan . |
| 5,522,572 | | 6/1996 | Copeland et al. . |
| 5,564,667 | | 10/1996 | Copeland et al. . |

(List continued on next page.)

OTHER PUBLICATIONS

Advertisement featured in *Ergonomics News*, vol. 3, No. 1, Jan./Feb. 1997.

Weber Knapp Company Catalog; "Ergonomic Workstation Components for Comfort and Functionality", WK–0157, 59510M, 1995.

*Primary Examiner*—Leslie A. Braun
*Assistant Examiner*—A. Joseph Wujciak
(74) *Attorney, Agent, or Firm*—Flynn, Thiel, Boutell & Tanis, P.C.

(57) ABSTRACT

A keyboard support tray arrangement includes both a main support tray for supporting a computer keyboard and an auxiliary support pad for supporting a user's palm or wrist. The auxiliary pad is removably and height adjustably positionable adjacent the front of the main keyboard tray to provide increased convenience and flexibility of use. The auxiliary support pad is completely separable from the main keyboard tray. A multi-height connecting and actuating structure enables the auxiliary pad to be positioned relative to the main keyboard tray at one of a plurality of heights by manual actuation of a single lever which is swingable through only a small angular extent.

13 Claims, 10 Drawing Sheets

U.S. PATENT DOCUMENTS

| | | | | |
|---|---|---|---|---|
| 5,568,907 | | 10/1996 | Wolfe et al. . | |
| 5,601,264 | | 2/1997 | Peart . | |
| 5,628,483 | | 5/1997 | Smith et al. . | |
| 5,685,235 | | 11/1997 | Allan . | |
| 5,692,712 | * | 12/1997 | Weinschenk, Jr. et al. | 248/118 |
| 5,810,301 | * | 9/1998 | McGrath et al. | 248/118 |
| 5,836,560 | | 11/1998 | Kaplan et al. . | |
| 5,938,352 | * | 8/1999 | Chen | 400/472 |
| 6,045,098 | * | 4/2000 | Timm | 248/118 |

* cited by examiner

KEYBOARD TRAY WITH ADJUSTABLE WRIST SUPPORT

FIELD OF THE INVENTION

This invention relates to a keyboard support tray arrangement for a computer and, more particularly, to an improved keyboard support tray arrangement employing an adjustable wrist/palm support pad.

BACKGROUND OF THE INVENTION

Articulated keyboard support mechanisms are typically mounted on and associated with work surfaces and desktops to support a computer keyboard. Such mechanisms are additionally often provided with an associated support pad for a user's wrist or palm. These support pads are conventionally fixed height foam or gel pads that lie along the front edge of the keyboard support on the upper surface thereof. While keyboarding, a user may rest his wrists or palms on the support pad to improve ergonomics. Different users require different heights in order to adequately support their hands. Moreover, recent developments in ergonomics suggest that a user should occasionally alter the position of their hands in an effort to reduce repetitive stresses. A fixed height support pad does not provide the desirable height adjustment relative to the keyboard. Moreover, keyboards may have different heights. Thus, one height of a support adjacent one keyboard may be inadequate adjacent a different keyboard. In fact, it may be desirable to remove the support from the keyboard support mechanism.

Numerous keyboard support mechanisms have been developed for supporting a keyboard adjacent a worksurface. Some keyboard support mechanisms include a wrist or palm support fixed to the tray supporting the keyboard. In known arrangements, the height of the wrist support is adjustable to account for the differences in keyboard construction and users. For example, in some keyboard support mechanisms, the wrist support cooperates with two separate rotatable threaded members, which are rotatably secured to the keyboard support tray and individually manually rotated for adjusting the height of respective ends of the wrist support. Users of these types of mechanism experience difficulties in maintaining the support pad in a level orientation due to the difficulty in synchronizing movement of the two threaded members. Moreover, the threads typically require a plurality of time-consuming revolutions to adjust the height of the wrist support. In other more structurally complex mechanisms, the wrist support cooperates with a single lateral slide, which is slidably secured to the keyboard support tray and laterally slides to adjust the height of the wrist support. Examples of prior keyboard support mechanisms are found in: U.S. Pat. Nos. 4,545,554; 5,219,136; 5,375,800; 5,421,543; 5,443,237; 5,507,458; and 5,836,560.

It is an object of the invention to provide an improved keyboard support arrangement that accommodates both a keyboard support tray and a wrist/palm support pad while greatly improving upon both the structure and the convenience and flexibility of use in comparison to known structures.

More specifically, it is an object of the invention to provide a height adjustable wrist/palm support pad arrangement which is supported by a pair of rotatable camming hubs which are linked for synchronous rotational displacement and one of which has a manually-engagable actuator part to enable simple height adjustment by an operator.

More specifically, the present invention relates to a keyboard support arrangement which includes both a main keyboard support tray and a height adjustable wrist/palm support pad removably secured to the main keyboard support tray so as to provide increased convenience and flexibility of use with respect to the support pad. In the improved support pad arrangement, the support pad is easily selectively separable from or mountable on the keyboard support tray. A connecting assembly is provided on the pad for removably securing the support pad to the tray.

In accordance with a preferred embodiment of the invention, the keyboard support arrangement includes a keyboard support tray and a wrist/palm support pad adapted to support a user's wrist or palm thereon. A connecting and height adjusting structure detachably fixes the support pad on the tray upper surface and positions the support pad at one of a plurality of different heights. In one position of the connecting and height adjusting structure, the support pad is removable from the tray. In a second position, the support pad is secured to the tray at a first height. In a third position, the support pad is secured to the tray at a second height.

Further in accordance with the preferred embodiment of the invention, the connecting and height adjusting structure has two interconnected hubs each including radial flanges which are rotatably received in channels in the tray to rotatably fix the hubs to the tray. Once the support pad is attached to the tray, the connecting and height adjusting structure adjusts the height of the support pad relative to the tray by rotation of the hub causing opposed cam elements to react with and effect height adjustment of the support pad.

Another object of the invention is to provide a single actuator for both releasing the support pad from the keyboard support tray and adjusting the height of the support pad relative to the tray. More specifically, the rotatable hubs are linked together, and one of the hubs has a manually-engagable actuator part to effect synchronous rotation of the linked hubs to adjust the height of the support pad or release the support pad from the keyboard support tray.

Other objects and purposes of the invention will be apparent upon reading the following specification and inspecting the accompanying drawings.

Figure 1:
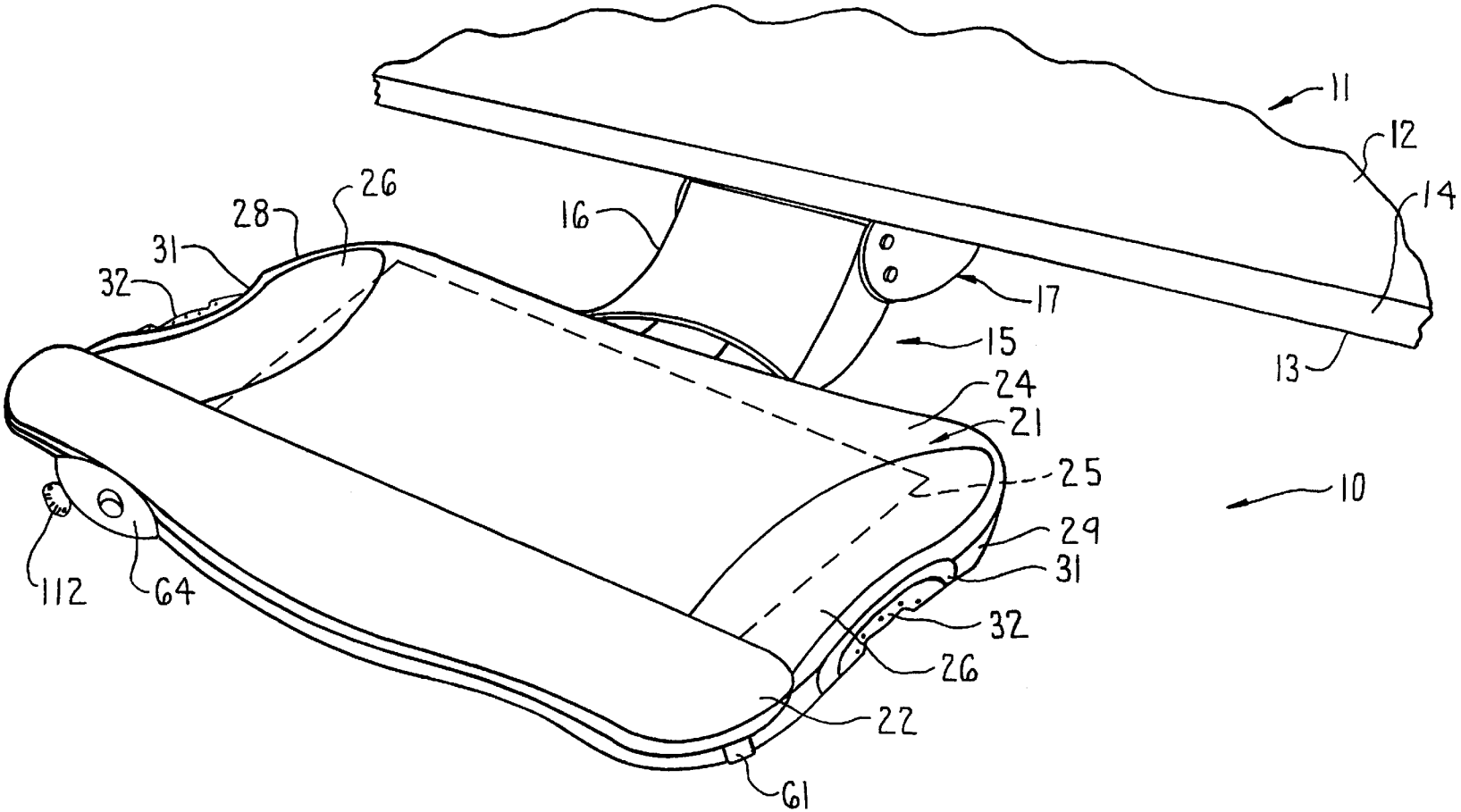
FIG. 1 is a perspective view illustrating the keyboard support arrangement and its attachment to and position adjacent a conventional work surface.

Certain terminology will be used in the following description for convenience in reference only, and will not be limiting. For example, the words "upwardly", "downwardly", "leftwardly" and "rightwardly" will refer to directions in the drawings to which reference is made. The word "forwardly" will be used in conjunction with the portions of the keyboard arrangement positioned closest to the user, and similarly the word "rearwardly" will refer to portions of the keyboard arrangement positioned remote from the user. The words "inwardly" and "outwardly" will refer to directions toward and away from, respectively, the geometric center of the overall arrangement and designated parts thereof. Said terminology will include the words specifically mentioned, derivatives thereof, and words of similar meaning.

DETAILED DESCRIPTION

Referring to the drawings, and specifically FIG. 1, there is illustrated an articulated keyboard support arrangement 10 according to the present invention. The arrangement 10 is adapted to be mounted on a conventional work surface or tabletop 11, the latter having generally horizontal and substantially planar upper and lower surfaces 12 and 13, respectively, with the work surface 11 terminating at a free front edge 14.

A linkage assembly 15 secures the support arrangement 10 to the tabletop 11. Examples of such a linkage assembly 15 are described in copending patent application Ser. No. 09/174,000 and U.S. Pat. No. 5,927,662, which are assigned to the same assignee as the present application. The '000 application and '662 patent are herein incorporated by reference. In brief, the connecting assembly 15 includes an elongate support arm 16, which at the rear end thereof couples to a carriage 17 that is positioned under the tabletop 11. The carriage 17 is preferably confined for sliding movement in a front-to-back direction of the tabletop 11 on an elongate track (not shown) stationarily and horizontally mounted on the lower surface 13 of tabletop 11. The forward end of the support arm 16 mounts thereon the keyboard support arrangement 10.

Figure 3:
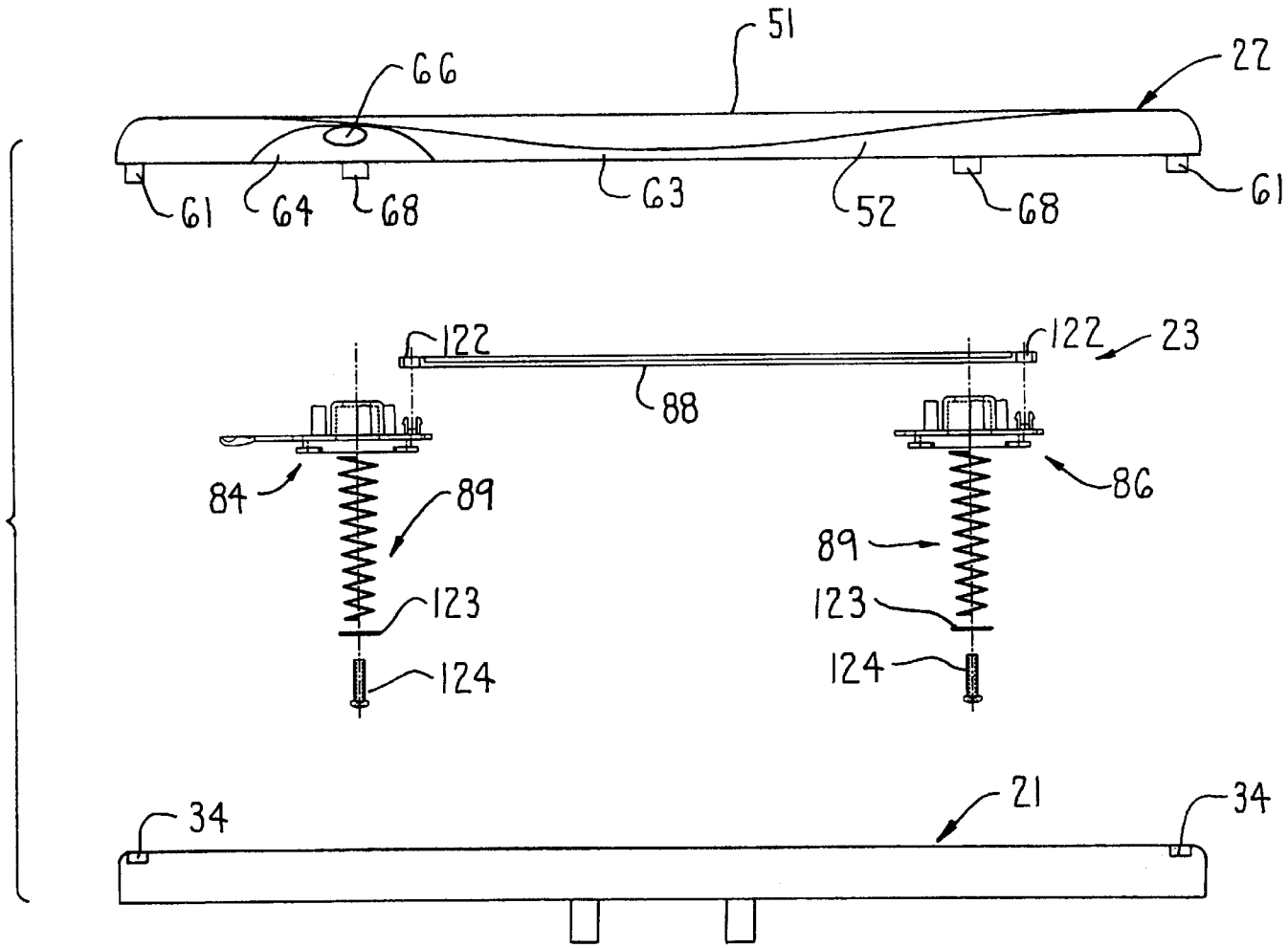
FIG. 3 is an exploded elevational view of the wrist/palm support pad arrangement of the present invention.

The keyboard support arrangement 10 includes a main keyboard support tray 21 and a support pad 22 for respectively supporting a computer keyboard and a user's wrist or palm. A connecting and height adjusting assembly 23 is fixed to the support pad 22. As best shown in FIG. 3, the connecting and height adjusting assembly 23 removably secures the support pad 22 to the tray 21 and adjusts the height of the support pad 22 relative to the tray 21.

Figure 2:
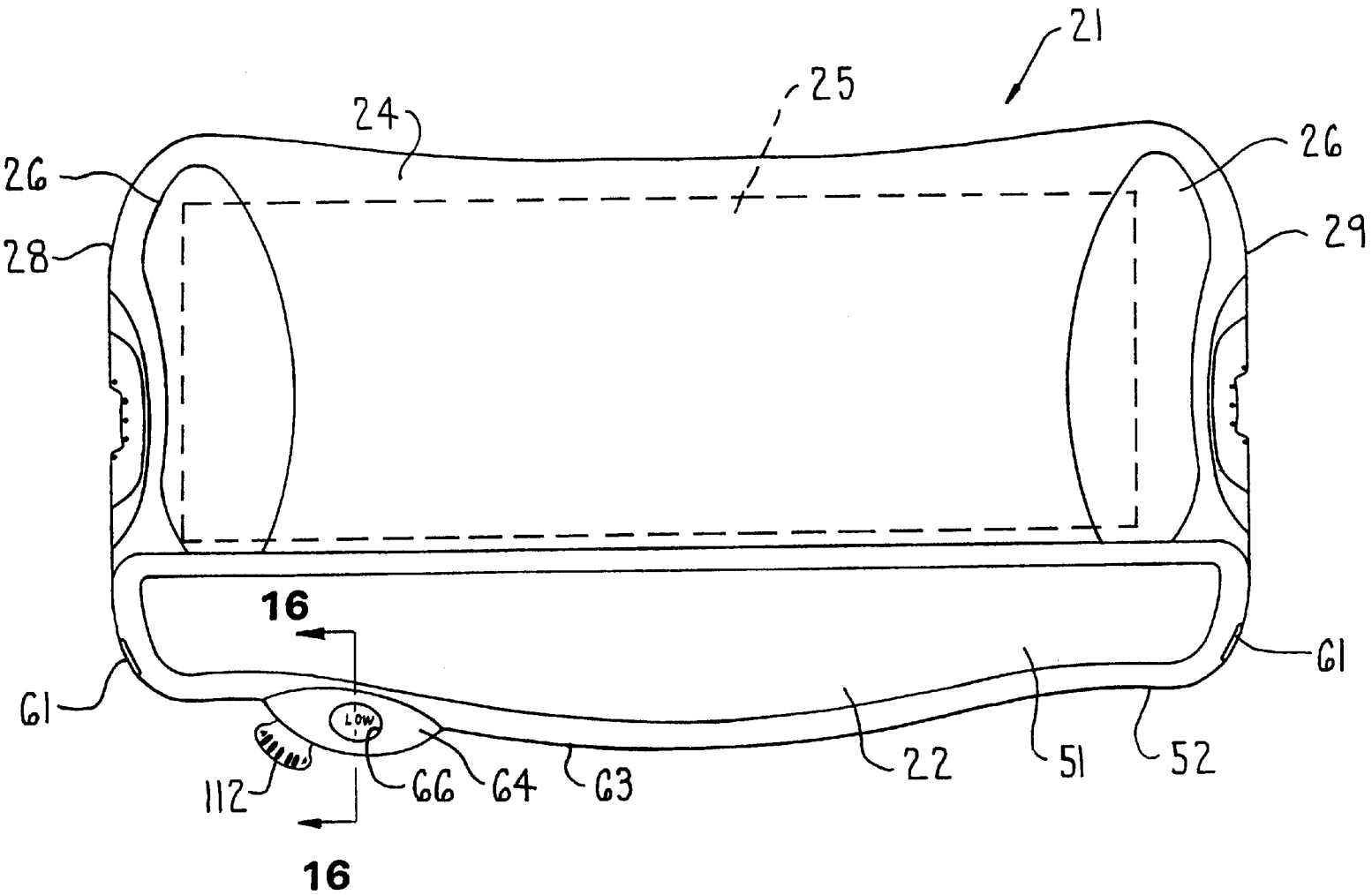
FIG. 2 is a top view illustrating the keyboard support arrangement including the main keyboard support tray and the height-adjustable wrist support pad according to the present invention.

Considering now FIGS. 1–4, the keyboard support tray 21 includes a generally horizontally enlarged and substantially planar upper surface 24 for supporting a conventional computer keyboard 25 thereon (shown in dotted lines in FIGS. 1 and 2). Grip surfaces 26 adjacent opposite sides of the tray upper surface 24 frictionally assist in holding the keyboard 25 on the tray. Ribs (not shown) may be positioned on the bottom surface of the tray to increase its strength and rigidity. The tray 21 may additionally include, substantially midway along each of right and left side edges 28 and 29 thereof, a recess 31 and a connecting member 32 located within recess 31. The recesses 31 and connecting members 32 allow an auxiliary pad (not shown) to be connected to either the right or left side of the tray as described in greater detail in the '000 application.

Figure 4:
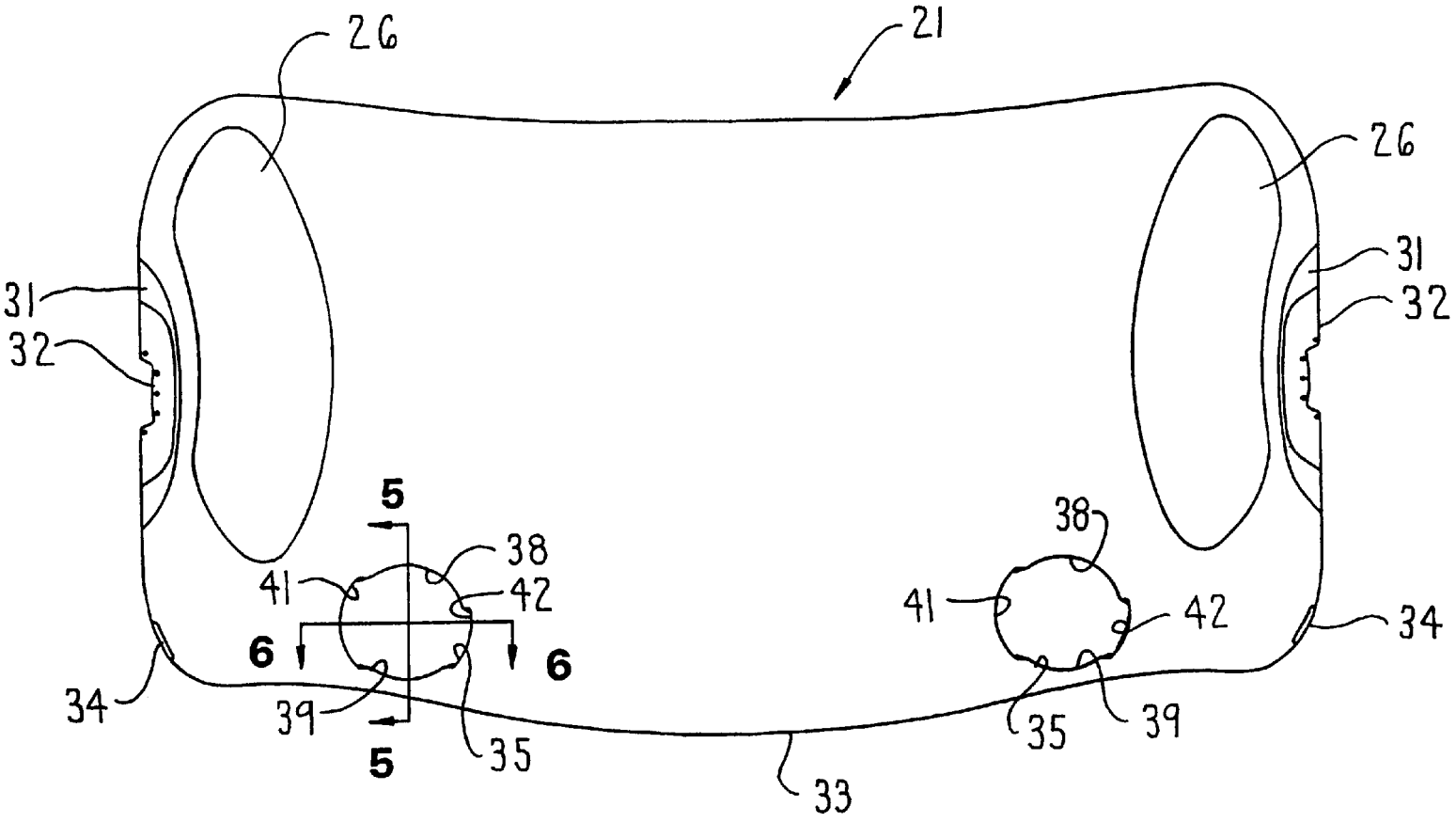
FIG. 4 is plan view the keyboard support tray.
Figure 6:
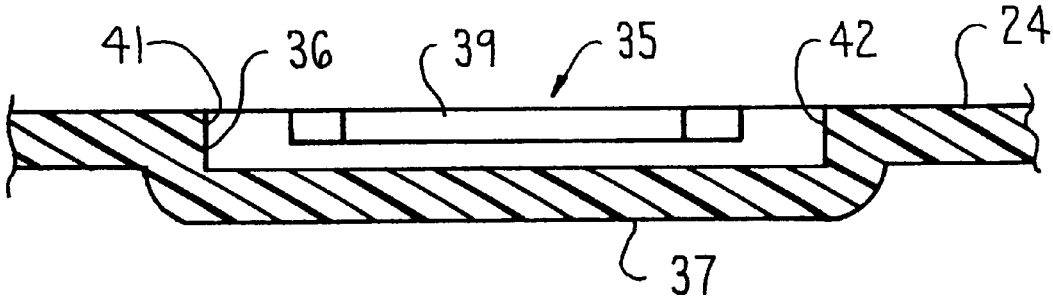
FIG. 6 is an enlarged, fragmentary, cross-sectional view taken generally along line 6—6 in FIG. 4.
Figure 5:
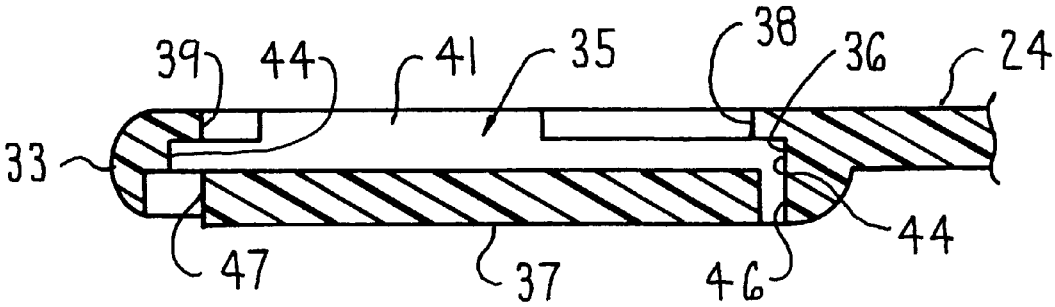
FIG. 5 is an enlarged, fragmentary, cross-sectional view taken generally along line 5—5 in FIG. 4.

Referring now to FIGS. 4–6, the keyboard support tray 21 also includes a longitudinally and vertically curved front edge 33 and a notch 34 recessed in each of the front corners thereof. Two upwardly open recesses 35 are positioned in the tray upper surface 24 adjacent the front edge thereof and respectively positioned to the left and right of a central outward curvature of the front tray edge 33. Both recesses 35 are generally cylindrical with the axes thereof extending generally perpendicular to the upper surface 24 and having a short axial length or depth relative to the diameter. More specifically, the recesses 35 are defined by an axially short cylindrical sidewall 36 extending downwardly from the tray upper surface 24 and a bottom wall 37 at the lower end of the sidewall 36 substantially closing the bottom of the recess 35. Arcuate flanges 38, 39 extend radially inwardly from the top of the sidewall 26 and have an upper surface generally coplanar with the upper tray surface 24. The first flange 38 is longer than the second flange 39. The flanges 38, 39 are circumferentially spaced from each other to create arcuate entry openings 41, 42 therebetween and are vertically spaced from the bottom wall 37 to create radially inwardly open slots 44. The left entry opening 41 (FIG. 4) is longer than the right entry opening 42. Directly beneath the flanges 38, 39, arcuate through channels 46, 47 are formed in the bottom wall 37 and have a length substantially equal to the length of corresponding flange.

Figure 7:
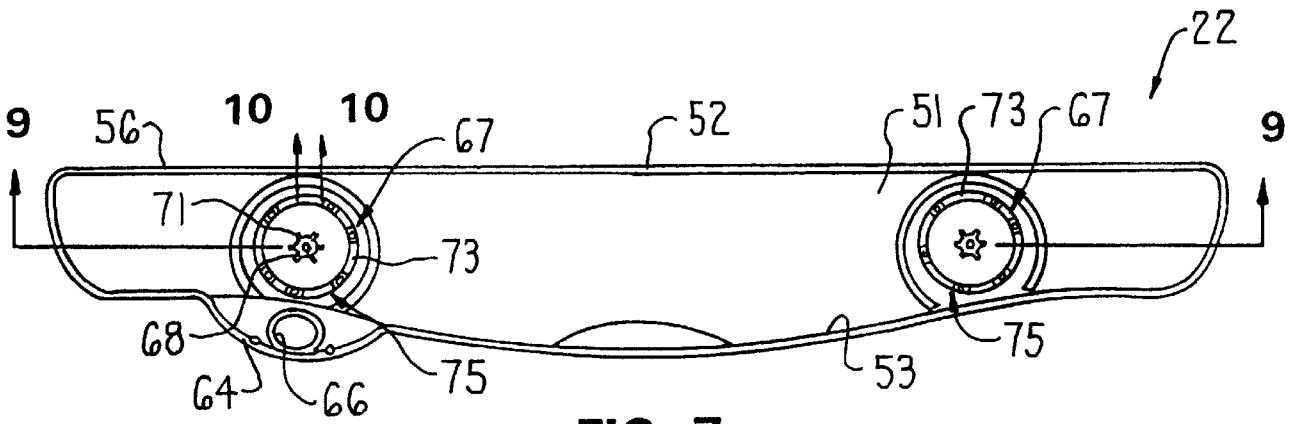
FIG. 7 is a bottom view of the wrist support pad.
Figure 8:
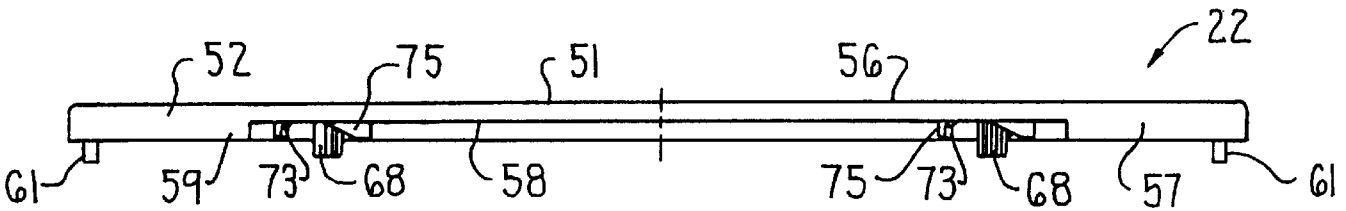
FIG. 8 is a rear elevational view of the wrist support pad.
Figure 9:
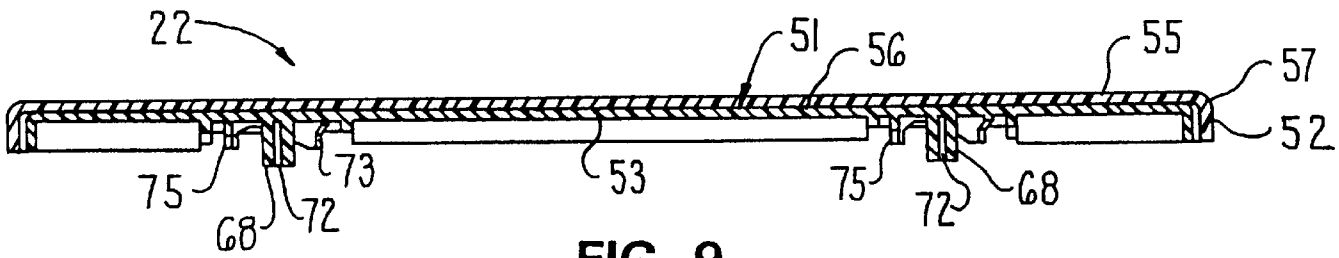
FIG. 9 is a cross-sectional view taken generally along line 9—9 of FIG. 7.

Considering now the support pad 22 (FIGS. 7–9), it has a generally inverted cup-like shape defined by a generally planar top wall 51 and an unending skirt 52 depending downwardly from the periphery of the top wall 51. In a preferred embodiment of the present invention, support pad 22 has a rigid plastic frame surrounded by a vinyl, user-contacting cushioning layer 55 fixed thereon. However, other constructions including an integrally molded plastic construction are within the scope of the present invention.

The top wall and skirt 51, 52 enclose a downwardly open cavity 53 and respectively have smooth outer top and side surfaces 56, 57 that may come into contact with a person using the support pad 22. The cavity 53 may house ribs (not shown) for reinforcing the top wall and skirt 51, 52. An elongate notch 58 is formed in the rear portion 59 of the skirt 52 and extends about two-thirds the length of the skirt rear portion 59. Resilient nubs 61 are integral with and extend downwardly adjacent the front corners of the skirt 52. The front portion 63 of the skirt 52 ideally has a curved shape similar to the front edge 33 of the keyboard tray 21, but includes a forward semi-oval protrusion 64 that slopes up to the top wall 51 at a reduced rate relative to the remainder of the skirt front portion 63. In the illustrated embodiment, the protrusion 64 is positioned to the left of the central outward protrusion of skirt front portion 63. A central window 66 extends vertically through the protrusion 64.

A mating structure 67 is provided on a bottom surface 69 of the top wall 51 in the cavity 53 for joining the connecting and height adjusting structure 23 to the palm or wrist support pad 22. The mating structure 67 includes identical left and right axles 68 cantilevered to the bottom surface 69 of the top wall 51 and extending into the cavity 53 adjacent respective left and right ends thereof. The axles 68 are spaced from each other at a distance less then the length of the notch 58 and have a height slightly greater the height of the skirt 52 so that the axles 68 extend just outside the cavity 53. Radially outwardly extending ribs 71 are formed along the length of the axles 66 to improve the strength and rigidity thereof. A fastener-receiving hole 72 is recessed in the free end and centered on the longitudinal axis of each axle 68.

The mating structure 67 further includes two sleeve-like cylindrical walls or cams 75 extending cantileveredly downwardly from the bottom surface 69 of the top wall 51, each wall 75 encircling a respective axle 68. The free end of each wall 75 is recessed to define an annular cam surface 73. The cam surfaces 73 are identical and thus only one will be described in detail. The cam surface 73 faces axially away from the bottom surface 69 of the top wall 51 and is radially spaced from the encircled axle 68. As shown linearly in FIG. 10 by taking a cross section along the center of cylindrical wall 75, the cam surface 73 has a tooth-like cam pattern 74 that repeats itself three times to complete a circle. Accordingly, each pattern 74 of the cam surface extends about 120 degrees around the wall 72. Each pattern 74 is the same, and therefore only one will be described in detail.

Figures 10, 11, 12, 13, 14:
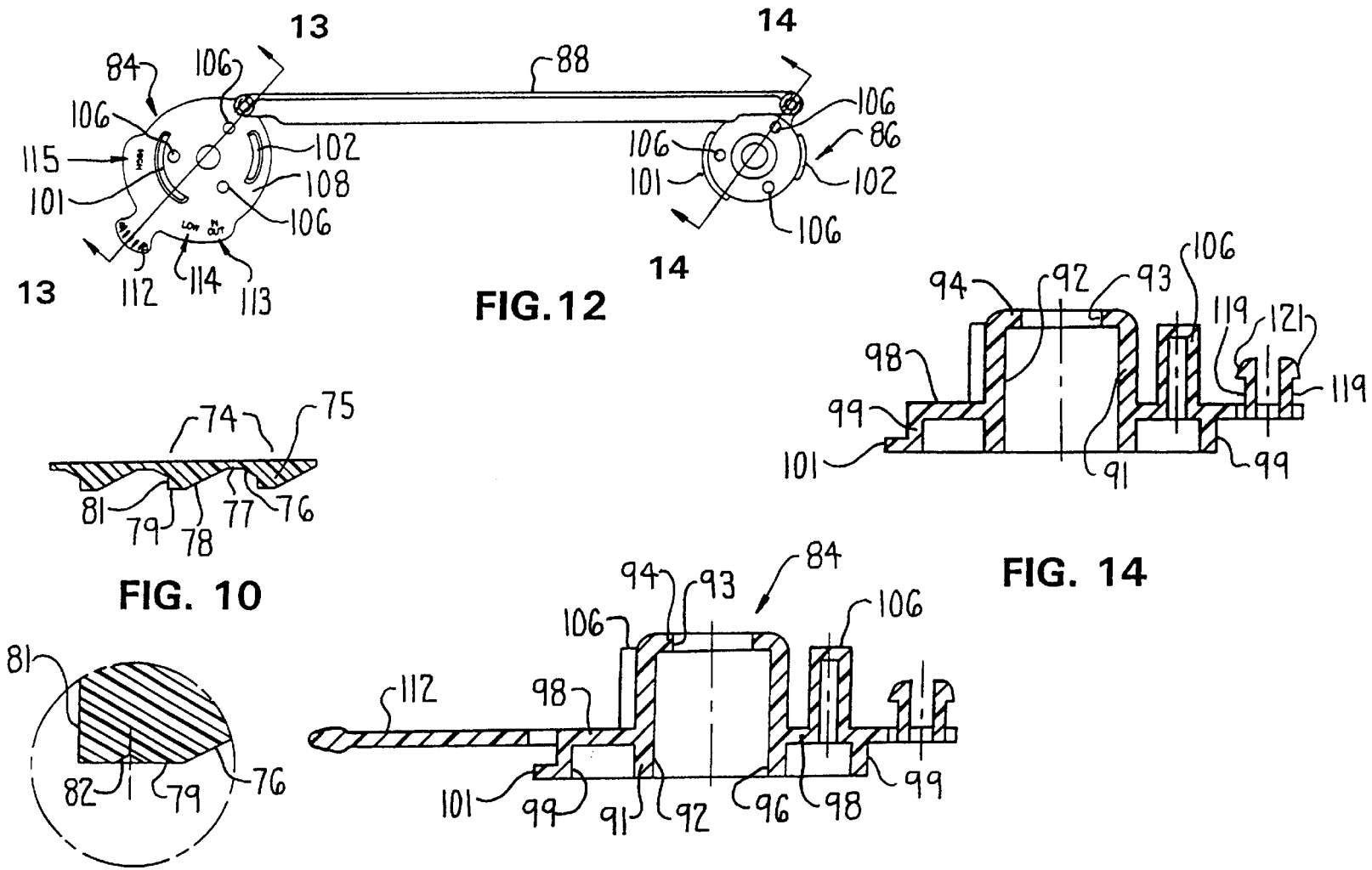
FIG. 10 is a cross-sectional view taken generally along line 10—10 of FIG. 7 (i.e. centrally through the cylindrical cam wall.
FIG. 11 is an enlarged, partial cross-sectional view of the lower flat of the cam surface taken from FIG. 10.
FIG. 12 is a plan view of the connecting and height adjusting structure associated with the wrist support pad.
FIG. 13 is an enlarged cross-sectional view taken generally along line 13—13 of FIG. 12.
FIG. 14 is an enlarged cross-sectional view taken generally along line 14—14 of FIG. 12.

In the clockwise direction (or leftwardly in FIG. 10), the cam surface pattern 74 begins with a short inclining ramp 76 followed by a short upper flat 77. The upper flat 77 precedes a long declining ramp 78, which in turn is followed by a lower flat 79. A generally vertical or axially extending wall or shoulder 81 transitions the flat 79 to the ramp 76, and thereafter begins an identical subsequent cam surface pattern. Both flats 77, 79 extend in vertically-spaced planes that are generally perpendicular to the center axis of the wall 75. The lower flat 79 is positioned within the cavity 53 and thus does not extend downwardly past the skirt front portion 63. A depression 82 is formed in the lower flat 79 (FIG. 11).

Considering now the connecting and height adjusting assembly 23 (FIGS. 3 and 12), it has two connecting members or hubs 84, 86 for removably connecting the support pad to the keyboard supporting tray 21. An elongate link 88 joins the hubs 84, 86, and a biasing mechanism 89 is mounted to each hub 84, 86. The two hubs 84, 86 are similar and thus one hub will be described in detail followed by the differences on each of the two hubs.

The hub 84 includes a central cylindrical hub part 91 and a longitudinally extending through opening 92, which is partially closed at an upper end 93 by an integral radially inwardly extending annulus 94. Thus, the opening at the hub upper end 93 has a smaller diameter than the opening at the lower end 96 of the hub part 91. An integral disk 98 extends annularly around the outer surface of the hub part 91 and is spaced upwardly a short distance from its lower end 96. An integral cylindrical rim 99 cantilevers downwardly from the outer peripheral edge of the disk 98 and ends at the same plane as the hub lower end 96. Arcuate flanges 101, 102 extend radially outwardly and partially along the free edge 104 of the rim 99 and are substantially coplanar to the hub lower end 96 and rim free edge 104. One flange 101 is longer than and positioned generally diametrically opposite the other flange 102. Cam followers formed as pins 106 stand upwardly from the disk 98 generally parallel to the center axis of the hub 91. The pins 106 are equal in number to the number of repeating patterns in the cam surface 73 and, consequently, in the illustrated embodiment there are three pins 106 on each hub 84, 86 spaced 120 degrees from each other.

The two hubs 84, 86 differ as follows. The disk 98 of control hub 84 (FIGS. 3 and 12) has an annular extension 108 extending outwardly through a greater radial extent than the disk 98 of hub 86. In the illustrated embodiment, the extension 108 is integral and coplanar with the disk 98. The extension 108 has through openings 109 aligned with each of the flanges 101, 102 and an arcuate projection 111 from which a control handle 112 extends radially outwardly. On the arcuate projection 111 there are a plurality of embossed indicators 113, 114, 115 that respectively indicate the in/out (insert/release) position of the hub, the low position, and the high position. The control handle 112 has upraised grips on both the lower and upper surfaces thereof to provide a gripping surface for a person grasping the control handle. The extension 108 also has, diametrically opposite the control handle 112, two opposed, spaced apart upstanding resilient cantilevered prongs 119 each having an outwardly projecting latch 121 adjacent the free end thereof.

The right hub 86 (FIGS. 3, 12 and 14), unlike the left hub 84, does not have an annular extension 108, but instead has ears 117, 118 extending radially outwardly directly from the peripheral edge of disk 98 and fixed thereto are two opposed, spaced apart upstanding resilient prongs 119 which each have an outwardly projecting latch 121 adjacent the free end thereof.

The connecting link 88 is an elongate bar which, in the preferred embodiment, has an L-shape cross section. The length of the link 88 is less than the length of the notch 58 in the skirt rear portion 59 and generally approximately equals the distance between axles 68. The link 88 has attachment apertures 122 at each end thereof extending generally transverse to the longitudinal direction of the link. The apertures 122 have diameters generally equal to the nonbiased position of the cantilevers 119.

During construction of the connecting and height adjustment assembly 23, the cantilevers 119 are forced into respective apertures 122 and yield to allow the latches 121 to pass through the apertures 123. Once past the apertures 122, the latches 121 are forced outwardly by the resilience of the cantilevers 119 and extend over the upper surface of the link 88 to pivotally join the link 88 to the hubs 84, 86 whereby relative rotational movement can occur between the cantilevers 119 and the link. Consequently, the link 88 connects the two hubs 84, 86 so that when the control hub 84 rotates, then the other hub 86 also rotates an equal amount.

The joined hubs 84, 86 and link 88 are mounted in the support pad cavity 53 with the prongs 117, 118 and connecting link 88 adjacent the notch 58 in the skirt rear portion 59. The upper end 93 of each hub part 91 slides over one of the axles 68. The ribs 71 of the axle having a maximum diameter slightly less than the opening at the hub upper end 93 so that the axle extends into the through opening 92 of the respective hub. In one method of mounting the hubs 84, 86 and link 88 to the mating structure 67 of the pad 22, the pins 106 are aligned with the upper flats 77 and the prongs 117, 118 and link 88 are partially received in the notch 58. A biasing member 89, here shown as a coil-type compression spring, is positioned in each of the voids between the hub wall 91 and axle 68. The biasing member 89 is held under tension in the void between the annulus 94 and washers 123 spaced from the annulus, the washers being positioned adjacent the lower end 96 of the hub. A fastener 124, shown as a screw in the illustrated embodiment, extends through the center opening of the washer 123 and is received in the fastener-receiving hole 72 to hold the washer at a fixed distance relative to the axle 68 and pad 22. The fastener 124, reverse functional description acting through the spring and washer, rotatably joins the hubs 84, 86 to the respective axles 68.

The spring member 89 has opposite ends thereof engaged and fixed to the washer 123 and hub top wall 93 respectively, and thus the spring 89 continuously biases the support pad downwardly toward the respective hub which in turn is fixed to the keyboard support tray 21. This causes the cylindrical cam 75 to be urged downwardly so that the annular cam surface 74 is maintained in contact with the free ends of the pins 106.

Figure 15:
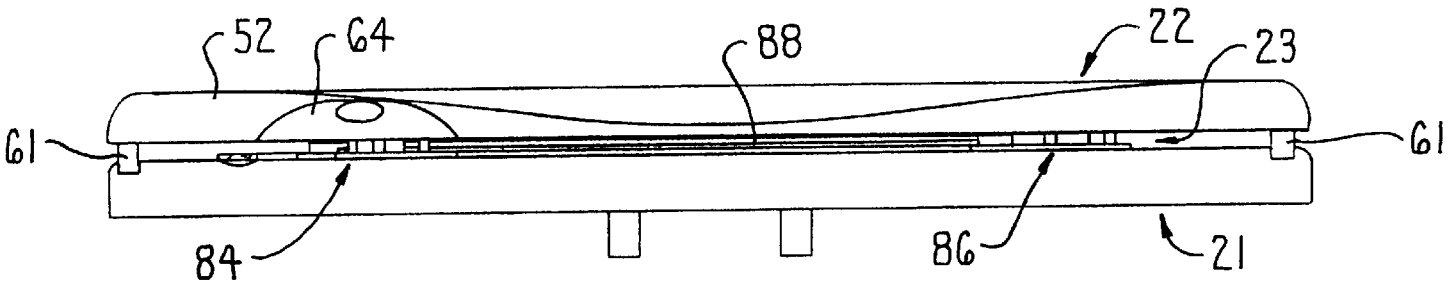
FIG. 15 is a front elevational view of the keyboard support arrangement with the wrist support pad in a lowered position as shown in FIGS. 1 and 2.
Figure 16:
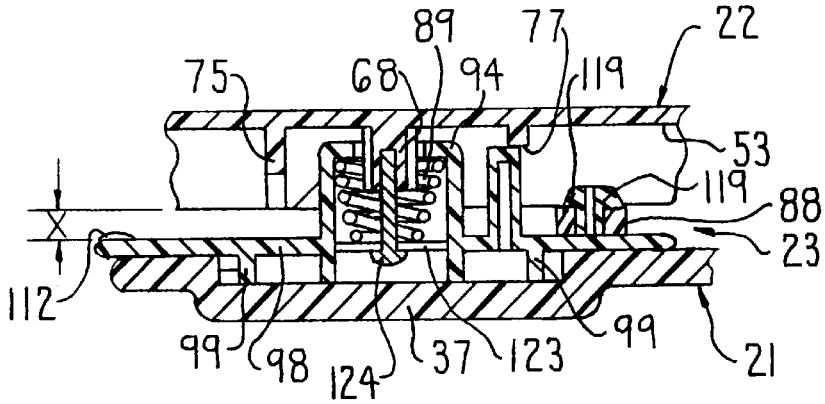
FIG. 16 is an enlarged, fragmentary cross sectional view taken generally along line 16—16 of FIG. 2 and showing the connecting and height adjusting structure in a lowered position.

The connecting and height adjusting assembly 23 has four distinct modes corresponding to the position of the pins 106 on the four distinct cam surfaces in each pattern 74, namely the ramp 76, upper flat 77, ramp 78 and lower flat 79. When the connecting and height adjusting assembly 23 is joined to the pad 22, the pins 106 are aligned with the upper flats 77, and this corresponds to the lowered position (FIGS. 15 and 16) of the support pad 22 as explained in greater detail below.

Figure 17:
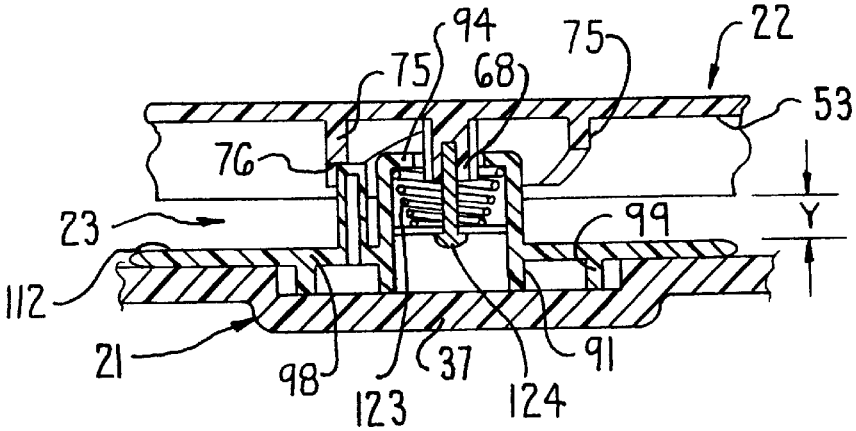
FIG. 17 is a view similar to FIG. 16 but showing the connecting and height adjusting structure in a released position.

However, the assembly 23 also has an in/out (or attachment) position (FIG. 17) to permit the pad 22 and connecting and actuating assembly 23 to be attached to or detached from the tray 21. When the pad 22 and the assembly 23 mounted thereon are detached from the tray 21, the assembly 23 is normally maintained in its lowered position wherein the springs 89 urge the ends of pins 106 into engagement with cam flats 77. To attach the pad 22 to the tray 21, the paid is positioned over the tray so that the lower ends of hubs 84, 86 are positioned directly over the recess 35.

A user grips the handle 112 and then rotates it clockwise in FIG. 2 so that the control hub 84 rotates about its associated axle 68 and the link 88 causes the other hub 86 to rotate about its associated axle 68. This causes the pins 106 to ride along the ramps 76 and also causes the flanges 101, 102 of the hub parts 91 on hubs 84, 86 to align with the entry openings 41, 42 of the respective tray recesses 35. That is, the longer flange 101 aligns with the larger entry opening 41 and the smaller flange 102 aligns with the smaller entry opening 42, with the front edge of the pad 22 aligned with the front edge 33 of the tray 21. In the illustrated embodiment, the attachment position is reached when the pins 106 ride completely up the ramps 76 and abut against the vertical shoulders 81. In this position, the indicator 113 is visible through the window 66 to inform the user that the connecting and height adjusting assembly is in the in/out position. While the flanges 101, 102 are being inserted downwardly into the entry openings 41, 42, the user must continue to hold the handle 112 in the in/out position against the urging of the spring member 89 which continuously urges the pins 106 downwardly along the ramps 76 toward the flats 77. More specifically, the spring member 89 in the in/out position is compressed between the washer 123 and the annulus 94. Once the hub flanges 101, 102 are fully received in the entry openings 41, 42, they are now rotatably aligned with the slots 44. The user now releases the handle 112, whereby the urging of the spring members 89 is sufficient to cause the pins 106 to ride down the corresponding ramps 76 back toward the flats 77 so as to rotate the hub flanges 101, 102 into the slots 44, thereby securing the connecting hubs 84, 86 to the tray 21. If the spring members 89 do not have sufficient force to cause the pins 106 to ride down the ramps 76, then the user may manually rotate the handle 112 counterclockwise so that the pins are again resting on the flats 77. In this lowered and connected position, the hub flanges 101, 102 are now at least partially received in the slots 44 defined by the tray flanges 38, 39 to define a bayonet-type lock that prevents the connecting and height adjusting assemblies 23 and pad 22 from being removed from the tray 21. In addition, in this lowered position, the indictor 114 is visible through the window 66.

If it is desired to remove the pad 22 from the tray 21, then the above procedure is followed in reverse order to move the connecting and actuating assembly 23 from the lowered position to the in/out position. More specifically, the user rotates the lever 112 clockwise so that the hub flanges 101, 102 align with the entry openings 41, 42, and the pad 22 and connecting and height adjusting assembly 23 are then lifted from the tray.

Figure 18:
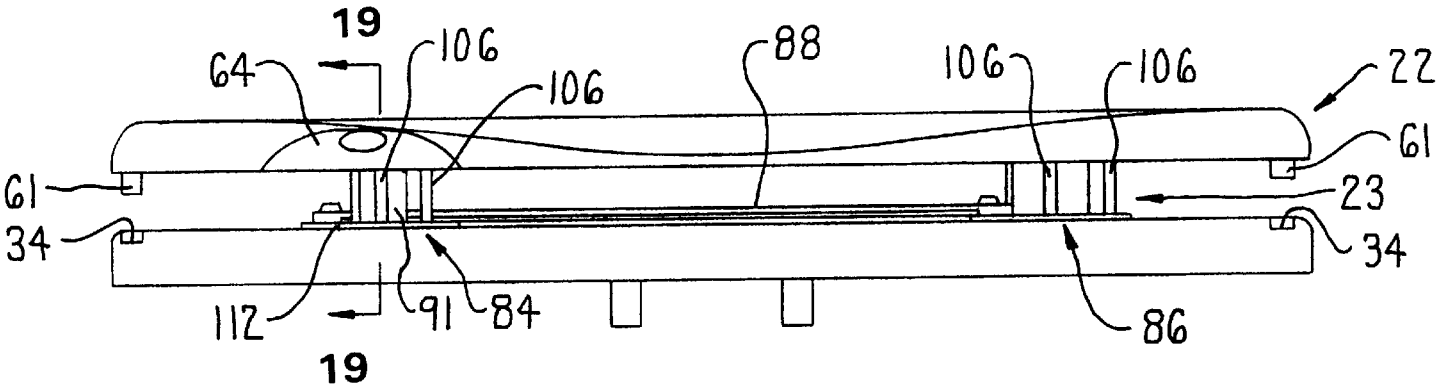
FIG. 18 is a front elevational view of the keyboard support arrangement similar to FIG. 15 but showing the wrist support pad in its raised position.
Figure 19:
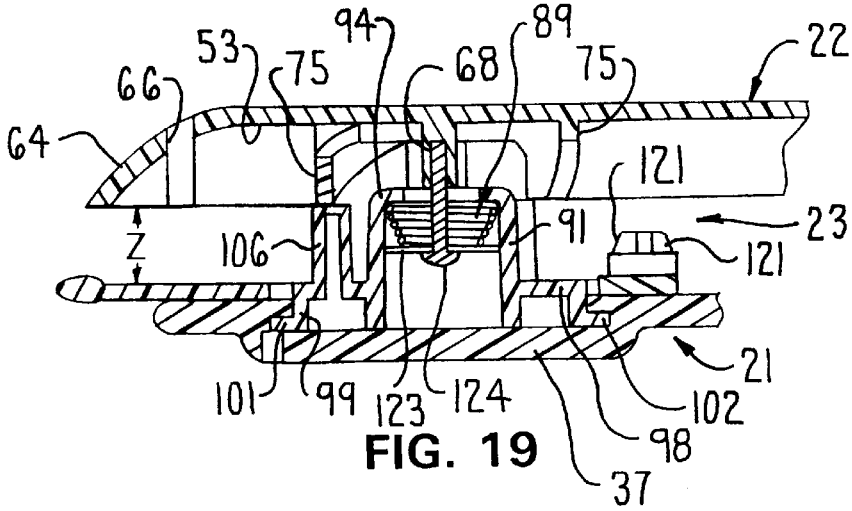
FIG. 19 is an enlarged fragmentary cross sectional view taken generally along line 19—19 in FIG. 18 and showing the connection and height adjusting structure in its raised position.
Figure 20:
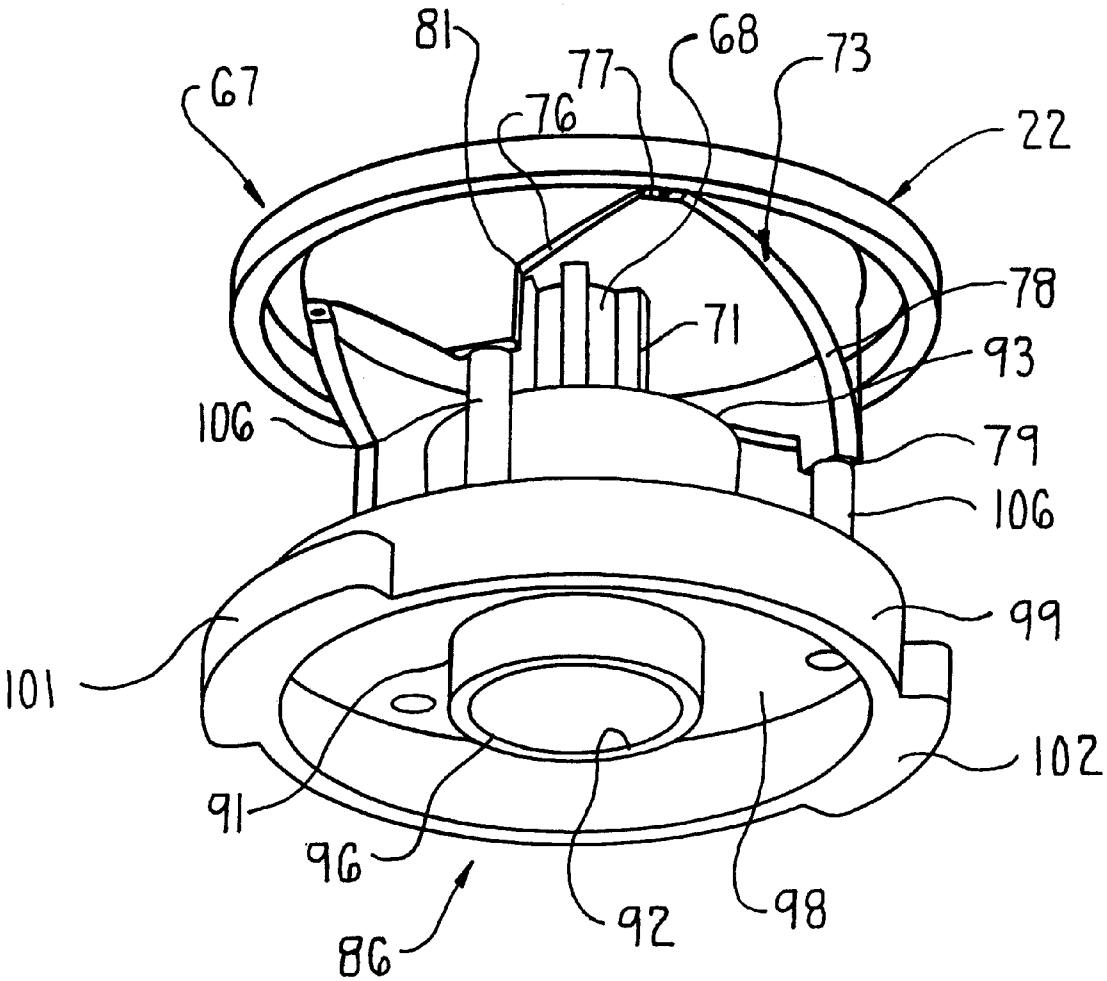
FIG. 20 is a perspective partial view of the connecting and height adjusting structure.

With the pad 22 secured to the tray 21 by the connecting and height adjusting assembly 23, it may be desired to alter the height of the pad 22 from the lowered position to another position, for example a high position (FIGS. 18 and 19). The user again grips the handle 112, however, this time the handle 112 is rotated counterclockwise (in FIG. 2) which causes the pins 106 to ride on the corresponding ramps 78 against the biasing force of the spring members 89 while the hub flanges 101, 102 rotate further into the slots 44. As the lever handle 112 rotates the control hub 84, the link 88 moves longitudinally to synchronously rotate the other hub 86. The notch 58 in the rearwall of pad 22 provides clearance for the link 88 during movement between the lowered and raised positions of the pad. The pins 106 travel throughout the lengths of the ramps 78 onto the lower flat 79. The pins 106 engage the detent-like depressions 82 on the flats 79 to assist in holding the pad 22 in the high position. In this position, the distance between the annulus 94 and washer 123 is at its least extent (FIG. 19) and thus the spring members 89 are subjected to their maximum compression.

To lower the pad 22 from the high position, the user again grips the lever 112 but rotates it clockwise. The biasing member 89 assists in moving the pins 106 down the ramps 78 to the flats 77 so as to return the pad 22 to the lowered position.

In the illustrated embodiment, there are three identical tooth-like patterns in the annular cam surface 73. Accordingly, to move from the insert/release position of the connecting and height adjusting structure 23 to the high position thereof, requires the lever 112 to travel about 120 degrees. Accordingly, the forward protrusion 64 on the pad 22 has an outer periphery that also measures about 120 degrees. The through window 66 of the protrusion 64 is centrally aligned and through which indicators 113, 114, 115 are visible. The in/out indicator 113 is visible through the window 66 to allow a user to visually confirm the insert/release position of the connecting and height adjusting structure 23. Likewise, indicators 114 and 115 are visible through the window 66 to allow a user to visually confirm the low and high positions of the connecting and height adjusting structure 23. Thus, the high and insert/release indicators 115 and 113, which are the most remote from each other, are spaced about 120 degrees from each other.

While the above description specifically addresses three identical repeating cam patterns in the cam surface 73, it will be understood that other numbers of patterns are also within the scope of the present invention. However, a plurality of at least three such patterns is preferred to stabilize the hubs 84, 86 as they rotate on the cam surfaces 73.

The arrangement of the present invention thus significantly adjusts the height of the support pad relative to the keyboard support by use of only a single manual lever swingable through only a small arc, which is less than one-half revolution. For example, the height of the support pad 22 is raised ⅜ inch by rotating control lever 112 less than 120°, preferably about 100°, from the low position to the high position.

Additionally it is within the scope of the present invention to flip flop the position of the cam follower 106 and the cam 74, and position the cam followers on the support pad and the cam on the hubs.

Although a particular preferred embodiment of the invention has been disclosed in detail for illustrative purposes, it will be recognized that variations or modifications of the disclosed apparatus, including the rearrangement of parts, lie within the scope of the present invention.

The invention claimed is:

1. A support tray arrangement for a computer keyboard, comprising:

a main keyboard support tray having a front side and a generally horizontally enlarged upper surface adapted for supporting a computer keyboard thereon;

a support pad positioned adjacent the front side of said tray and having an outer surface adapted for supporting a user's hand or wrist thereon;

first and second connecting members connected to said support pad for rotational movement to adjust the height of said support pad and for joining said pad to said tray; and a linkage joining said first and second connecting members so that rotation of said first connecting member correspondingly rotates said second connecting member to adjust the height of said support pad relative to said tray.

2. The arrangement according to claim 1, wherein said support tray includes first and second recesses in said upper surface, said first and second recesses each having at least one radially inwardly extending securing flange and a slot beneath said flange; and said first and second connecting members each having at least one radially outwardly extending connecting flange, said connecting flange being received in said slot beneath said securing flange so as to secure said first and second connecting members respectively in said first and second recesses and allow said first and second connecting members to rotate in said first and second recesses.

3. The arrangement according to claim 1, wherein said support pad has first and second cam surfaces fixed on the underside thereof facing said upper surface of said tray, said first and second connecting members respectively including first and second cam followers in contact respectively with said first and second cam surfaces, said first and second cam followers riding on said first and second cam surfaces during rotation of said first and second connecting members to select the position of the support pad.

4. The arrangement according to claim 3, wherein said support pad includes first and second axles cantilevered from the underside thereof, said first and second cam surfaces being respectively positioned on first and second cylindrical walls extending downwardly from said underside of said support pad and respectively encircling said first and second axles, said first and second connecting members each including a central hub with an axial through opening and a disk extending radially outwardly from said hub with said cam followers extending upwardly from said disk, said through openings of said first and second hubs respectively receiving said first and second axles therein and being rotatable therearound.

5. The arrangement according to claim 4, wherein first and second biasing members are respectively positioned within said first and second hubs in surrounding relation to the respective axle, first and second fasteners respectively connected to said first and second axles, first and second stops spatially fixed relative to said support pad by said first and second fasteners, and said first and second biasing members being respectively compressively confined between said first and second stops and opposed annular walls of said hubs to urge said first and second connecting members upwardly toward said support pad.

6. A support tray arrangement for a computer keyboard, comprising:

a keyboard support structure having an elongate, generally horizontally enlarge upper surface adapted to support a keyboard thereon;

a pad structure overlying a front portion of said upper surface of said keyboard support structure and adapted to support a user's wrist or palm adjacent a keyboard supported on said keyboard support structure;

a cam structure connecting said pad structure to said keyboard structure, said cam structure including first and second rotatable cam parts both connected to one of said keyboard support and pad structures and first and second fixed cam parts both connected to the other of said keyboard support and pad structures, said first and second rotatable cam parts respectively camming on said first and second fixed cam parts to adjust the height of the pad structure relative to the keyboard support structure; and a link extending along the length of said pad structure connecting said first and second rotatable cam parts for synchronous rotation.

7. The arrangement according to claim 6, wherein said first rotatable cam part includes a control lever extending forwardly of said pad structure for manual engagement through less than one-half rotation to achieve full height displacement of said pad structure relative to said keyboard support structure.

8. The arrangement according to claim 7, wherein said control lever rotates through an arc of less than 120 degrees to move said pad structure between a high position and a low position and vice versa.

9. The arrangement according to claim 6, wherein said first and second rotatable cam parts are rotatably connected to said pad structure, and said first and second fixed cam parts are cam surfaces on said pad structure.

10. The arrangement according to claim 9, wherein said first and second rotatable cam parts include radially outwardly extending flanges, and said tray includes first and second recesses and radially inwardly extending flanges spaced from one another at the opening of each said recess to define entry openings therebetween, said first and second cam parts being rotatable to an insert position whereat said flanges on said first and second rotatable cam parts align with said entry openings so that said first and second rotatable cam parts are inserted into said recesses and being rotatable to a joined position with said flanges on said rotatable cam parts at least partially beneath respective said flanges on said keyboard support tray structure to secure said rotatable cam parts and said pad structure to said keyboard support tray structure.

11. The arrangement according to claim 10, wherein said support pad structure includes a main pad and a biasing assembly between said main pad and said first rotatable cam part urging said cam surface of said first fixed cam part to said first rotatable cam part to assist in moving said first rotatable cam part into the joined position.

12. The arrangement according to claim 11, wherein said cam surface of said first fixed cam part includes a ramp on which said first rotatable cam part abuts in said insert position so that said biasing assembly urges said first fixed cam part to said joined position.

13. The arrangement according to claim 9, wherein said first and second rotatable cam parts join said keyboard support structure and said pad structure, said pad structure including a main pad and a biasing member urging said main pad toward said keyboard support structure, said first rotatable cam part rotating through less than one rotation on said cam surfaces of said fixed cam parts against the urging of said biasing member to move said main pad away from said keyboard support tray from a low position to a high position.

* * * * *